US012747886B2

(12) United States Patent
Jiang et al.

(10) Patent No.: US 12,747,886 B2
(45) Date of Patent: Sep. 29, 2026

(54) AIR CONDITIONING SYSTEM AND A CONTROL METHOD THEREOF

(71) Applicant: Guilin Fengyang Technology Co., Ltd., Guilin City (CN)

(72) Inventors: Xiao Jiang, Guilin City (CN); Yang Yang, Guilin City (CN); Huibin Qin, Guilin City (CN); Yonggao Jiang, Guilin City (CN); Kai Liu, Guilin City (CN)

(73) Assignee: GUILIN FENGYANG TECHNOLOGY CO., LTD., Guilin City (CN)

( * ) Notice: Subject to any disclaimer, the term of this patent is extended or adjusted under 35 U.S.C. 154(b) by 126 days.

(21) Appl. No.: 18/817,398

(22) Filed: Aug. 28, 2024

(65) Prior Publication Data

US 2025/0075935 A1 Mar. 6, 2025

(30) Foreign Application Priority Data

Aug. 28, 2023 (CN) ..... 202311092002.3

(51) Int. Cl.
*F24F 11/84* (2018.01)

(52) U.S. Cl.
CPC ..... *F24F 11/84* (2018.01)

(58) Field of Classification Search
CPC ..... F24F 11/84; F24F 1/0093; F24F 1/0375; F24F 1/0326; F24F 2203/1036; F24F 5/0089–0092
See application file for complete search history.

(56) References Cited

FOREIGN PATENT DOCUMENTS

| | | | | |
|---|---|---|---|---|
| CN | 105972796 A | | 9/2016 | |
| CN | 111059628 A | * | 4/2020 | ..... F24F 1/0059 |
| CN | 114076395 A | | 2/2022 | |
| CN | 114111016 A | | 3/2022 | |

(Continued)

OTHER PUBLICATIONS

Machine English translation of CN111059628 to Li et al. Translated Feb. 2026 (Year: 2020).*

(Continued)

*Primary Examiner* — Cassey D Bauer
(74) *Attorney, Agent, or Firm* — Calfee, Halter & Griswold LLP

(57) ABSTRACT

An indoor unit comprises a built-in heat exchanger and a radiant heat dissipation casing, the radiant heat dissipation casing serving both as a protective casing for the indoor unit and as a radiant heat sink. The radiation heat dissipation casing is arranged in parallel with the built-in heat exchanger. When users need to quickly adjust the indoor temperature, they can switch on the radiant heat dissipation casing and the built-in heat exchanger at the same time, and the radiant heat dissipation casing and the built-in heat exchanger will exchange heat together to quickly adjust the indoor temperature. Users can also choose to separately use the built-in heat exchanger to adjust the indoor temperature to meet the needs of different users and operation conditions. After the indoor temperature reaches the preset temperature, users can choose to switch off the built-in heat exchanger and keep the radiant heat dissipation casing on.

8 Claims, 9 Drawing Sheets

(56) References Cited

FOREIGN PATENT DOCUMENTS

| | | | | |
|---|---|---|---|---|
| DE | 102009055443 A1 * | 7/2011 | ..... | C04B 26/02 |
| JP | 5544580 B1 * | 7/2014 | ..... | F24F 11/67 |

OTHER PUBLICATIONS

Machine English language translation of JP5544580 to Murakami. Translated Feb. 2026 (Year: 2014).*
Machine English language translation of DE 102009055443 to Guckert et al. Translated Feb. 2026 (Year: 2011).*
First office action of CN application No. 202311092002.3 dated Jun. 6, 2025.

* cited by examiner

A-A

AIR CONDITIONING SYSTEM AND A CONTROL METHOD THEREOF

RELATED APPLICATIONS

This application claims priority to Chinese Application No. 202311092002.3, filed Aug. 28, 2023, the entire disclosure of which is incorporated herein by reference in its entirety.

TECHNICAL FIELD

The application relates to the technical field of air conditioning, and specifically to an air conditioning system and control method thereof.

BACKGROUND

In the field of air conditioning, a cabinet unit is a commonly used indoor air conditioning internal unit, which comprises a casing, a heat exchanger and a fan mounted inside the casing. The indoor unit and the outdoor unit form an air conditioning system, and the indoor unit is used to supply cooling and heating to the room.

However, the existing indoor units blow cold or hot air into the room through a fan. When the indoor temperature reaches the user's desired temperature, if the fan continues to blow air, it is easy to cause the indoor temperature to be too low or too high. If cold or hot air blows towards the user's body, the user will feel too cold or too hot, resulting in a poor user experience. In the prior art, one way is to use inverter air conditioner to achieve automatic control, however, it completely relies on the fan to achieve. When the temperature reaches the user's preset temperature, the fan is switched off or slowed down, and when the temperature exceeds the preset range, the fan is turned on or accelerated again, and such operation will still cause the indoor temperature to change too quickly, and there is a cold or hot air constantly blowing, affecting the user's experience. In addition, noise will also be produced during the switching on and off process of the fan, affecting the user's sleep.

SUMMARY

The application aims to overcome the defects in the prior art, and provide a new air conditioning system and the control method thereof, wherein the casing of the indoor unit is a radiant heat sink, the radiant heat sink may cooperate with a built-in heat exchanger to exchange the heat together in order to adjust the indoor temperature quickly. After the indoor temperature reaches a preset temperature, the built-in heat exchanger is switched off and only the radiant heat dissipation casing is used to dissipate heat, in order to slowly dissipate the heat to the room, to keep the indoor temperature within a certain range, there will be no cold or hot air continuously blowing to the user, and there will be no noise, which enhances the user's experience.

A technical solution of the application provides an air conditioning system comprising an indoor unit, an outdoor unit, a medium circulation pipe and a control unit;

the indoor unit and the outdoor unit are connected through the medium circulation pipe, and the outdoor unit is in signal communication with the control unit;

the indoor unit comprises a radiant heat dissipation casing having a medium flow channel and a built-in heat exchanger and a fan mounted in the radiant heat dissipation casing, the fan is in signal communication with the control unit;

the radiant heat dissipation casing comprises an air inlet and an air outlet;

the radiant heat dissipation casing and the built-in heat exchanger are connected with the medium circulation pipe respectively, and the radiant heat dissipation casing is arranged in parallel with the built-in heat exchanger;

the indoor unit has a first operation mode, in which both the radiant heat dissipation casing and the built-in heat exchanger are in a heat exchange operation state;

the indoor unit has a second operation mode, in which the built-in heat exchanger is in a heat exchange operation state and the radiant heat dissipation casing is in an inoperation state;

the indoor unit has a third operation mode, in which the radiant heat dissipation casing is in a heat exchange operation state and the built-in heat exchanger is in an inoperation state.

In one of the optional technical solutions, the radiant heat dissipation casing comprises a plurality of the medium flow channels.

In one of the optional technical solutions, the medium circulation pipe comprises a main pipe connected with the outdoor unit, a first branch pipe connected between the main pipe and the built-in heat exchanger, and a second branch pipe connected between the main pipe and the radiant heat dissipation casing;

the first branch pipe and the second branch pipe are each provided with a control valve, the control valve is in signal communication with the control unit.

In one of the optional technical solutions, the air conditioning system also comprises a temperature sensor for monitoring indoor temperature, the temperature sensor is in signal communication with the control unit.

In one of the optional technical solutions, a temperature threshold is preset in the control unit, the temperature threshold comprises a cooling temperature threshold and a heating temperature threshold;

the cooling temperature threshold comprises T1 and T2, wherein $T1<T2$;

when the temperature sensor monitors an indoor temperature $T0\geq T2$, the indoor unit is in the first operation mode;

when the temperature sensor monitors an indoor temperature $T1\leq T0<T2$, the indoor unit is in the second operation mode;

when the temperature sensor monitors an indoor temperature $T0<T1$, the indoor unit is in the third operation mode;

the heating temperature threshold comprises T3 and T4, wherein $T3<T4$;

when the temperature sensor monitors an indoor temperature $T0\leq T3$, the indoor unit is in the first operation mode;

when the temperature sensor monitors an indoor temperature $T3\leq T0<T4$, the indoor unit is in the second operation mode;

when the temperature sensor monitors an indoor temperature $T0\geq T4$, the indoor unit is in the third operation mode.

In one of the optional technical solutions, the radiant heat dissipation casing comprises a plurality of housing modules connected in sequence, an outer surface of the housing module has heat dissipation fins.

Each of the housing modules has at least one of the medium flow channels.

In one of the optional technical solutions, one end of the housing modules has a buckle and the other end of the housing modules has a slot;

in any of the two adjacent housing modules, the buckle of one of the housing modules is in snap-fit connection with the slot of another of the housing modules.

In one of the optional technical solutions, the housing module is in the shape of arc and the plurality of the housing modules are sequentially connected to form a circular structure; or the housing modules is in the shape of rectangle, and the plurality of the housing modules are sequentially connected to form a square structure, wherein the slots are also provided at both end of an inner surface of the housing module, the buckle of one of two vertically arranged housing modules is snap-fitted into the slot of the other housing module.

In one of the optional technical solutions, an outer side of the medium flow channel is covered with a thermally conductive sound deadening medium.

A technical solution of the application provides a control method of the air conditioning system as described in the previous technical solution, wherein the control method comprises the following steps:

the step of simultaneously switching on the built-in heat exchanger and the radiant heat dissipation casing, such that the radiant heat dissipation casing and the built-in heat exchanger is in a heat exchange operation state;

the step of individually switching on the built-in heat exchanger, such that the built-in heat exchanger is in a heat exchange operation state and the radiant heat dissipation casing is in an inoperation state;

the step of individually switching on the radiant heat dissipation casing, such that the radiant heat dissipation casing is in a heat exchange operation state and the built-in heat exchanger is in an inoperation state.

By adopting the technical solutions above, the application has the following beneficial effects:

The application provides an air conditioning system and a control method thereof, wherein an indoor unit comprises a built-in heat exchanger and a radiant heat dissipation casing, the radiant heat dissipation casing serving both as a protective casing for the indoor unit and as a radiant heat sink. The radiation heat dissipation casing is arranged in parallel with the built-in heat exchanger. When users need to quickly adjust the indoor temperature, they can switch on the radiant heat dissipation casing and the built-in heat exchanger at the same time, and the radiant heat dissipation casing and the built-in heat exchanger will exchange heat together to quickly adjust the indoor temperature. Users can also choose to separately use the built-in heat exchanger to adjust the indoor temperature to meet the needs of different users and operation conditions. After the indoor temperature reaches the preset temperature, users can choose to switch off the built-in heat exchanger and keep the radiant heat dissipation casing on, only dissipating heat through the radiant heat dissipation casing, in order to slowly dissipate the heat to the room, to keep the indoor temperature within a certain range, there will be no cold or hot air continuously blowing to the user, and there will be no noise, which enhances the user's experience.

DESCRIPTION OF THE DRAWINGS

With reference to the drawings, the contents disclosed by the application will be more easily understood. It should be understood that: these drawings are merely used for illustration, and are not intended to limit the protection scope of the application. In the drawings.

DESCRIPTION OF EXEMPLARY EMBODIMENTS

Figure 1:
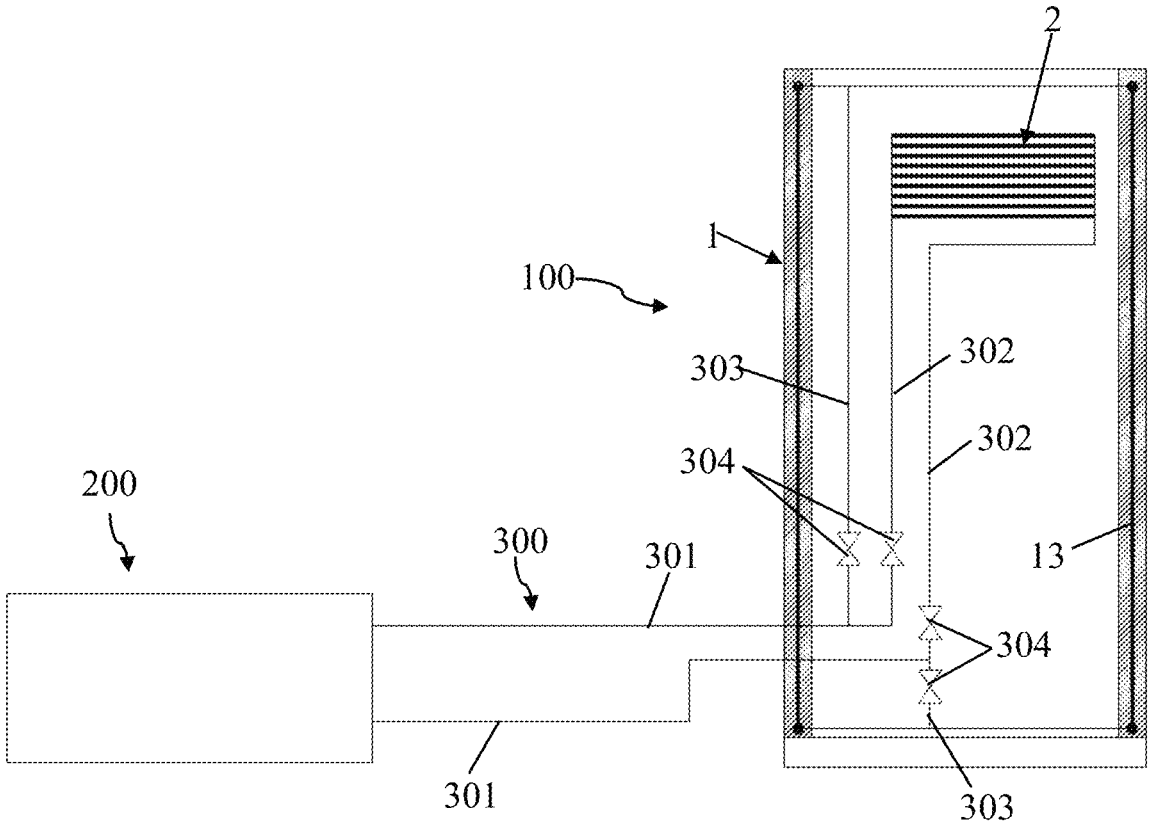
FIG. 1 is a schematic diagram of an air conditioning system provided by one embodiment of the application.

The specific embodiments of the application will be further described with reference to the drawings hereinafter. Same parts are denoted by same reference numerals. It should be noted that the terms "front", "back", "left", "right", "up" and "down" used in the following description refer to the directions in the drawings, and the terms "inner" and "outer" refer to the directions towards or far away from geometric centers of specific parts respectively.

As shown in FIGS. 1 to 4, FIG. 8, and FIG. 10, an air conditioning system provides by an embodiment of the application comprises an indoor unit 100, an outdoor unit 200, a medium circulation pipe 300 and a control unit 400.

The indoor unit 100 and the outdoor 200 unit are connected through the medium circulation pipe 300, and the outdoor unit 200 is in signal communication with the control unit 400.

The indoor unit 100 comprises a radiant heat dissipation casing 1 having a medium flow channel 13 and a built-in heat exchanger 2 and a fan 3 mounted in the radiant heat dissipation casing 1, the fan 3 is in signal communication with the control unit 400.

The radiant heat dissipation casing 1 comprises an air inlet 11 and an air outlet 12.

The radiant heat dissipation casing 1 and the built-in heat exchanger 2 are connected with the medium circulation pipe 300 respectively, and the radiant heat dissipation casing 1 is arranged in parallel with the built-in heat exchanger 2.

The indoor unit 100 has a first operation mode, in which both the radiant heat dissipation casing 1 and the built-in heat exchanger 2 are in a heat exchange operation state.

The indoor unit 100 has a second operation mode, in which the built-in heat exchanger 2 is in a heat exchange operation state and the radiant heat dissipation casing 1 is in an inoperation state.

The indoor unit 100 has a third operation mode, in which the radiant heat dissipation casing 1 is in a heat exchange operation state and the built-in heat exchanger 2 is in an inoperation state.

The air conditioning system provides by an embodiment of the application comprises the indoor unit 100, the outdoor unit 200, the medium circulation pipe 300 and the control unit 400.

The indoor unit 100 can be a wall-mounted air conditioner indoor unit or a standing air conditioner indoor unit (cabinet unit). Preferably, the indoor unit 100 is a standing air conditioner indoor unit (cabinet unit), which has a radiant heat dissipation casing 1 with a large area, strong radiation heat exchange capability, and a large space for effective heat exchange.

The outdoor unit 200 is a traditional air conditioner outdoor unit, which has components such as a compressor inside.

The medium circulation pipe 300 is used to circulate heat exchange medium, also called air conditioning medium, for example, Freon.

The control unit 400 is a control module such as a controller or a chip used to control the switching operation of each component. It can be mounted on a panel of the indoor unit 100 or a remote controller may be adopted to achieve control.

Wherein, the indoor unit 100 comprises the radiant heat dissipation casing 1, the built-in heat exchanger 2, the fan 3, etc. The built-in heat exchanger 2 and the fan 3 are mounted in the radiant heat dissipation casing 1. When the built-in heat exchanger 2 is switched on, the fan 3 is switched on synchronously. The built-in heat exchanger 2 is a convection heat exchanger using a conventional fan 3.

The radiant heat dissipation casing 1 is used as a protective casing on the one hand, and as a radiant heat sink or radiant heat exchanger on the other hand. Radiant heat sink or radiant heat exchanger refers to a heat exchanger or heat sink that does not require blowing equipment such as fans and relies solely on its own radiation ability to exchange heat with or dissipate heat to the surrounding air. The heat exchange and heat dissipation referred to in the present application include not only heat energy exchange and heat energy release, but also cold energy exchange and cold energy release, which can realize the functions of indoor cooling and heating.

The radiant heat dissipation casing 1 comprises the air inlet 11 and the air outlet 12, generally, the air inlet 11 is provided on a back side, a lower side or a side of the radiant heat dissipation casing 1, and the air outlet 12 is provided on a front side or around the radiant heat dissipation casing 1. The air inlet 11 is used for ambient air to enter the radiant heat dissipation casing 1 to exchange heat with the built-in heat exchanger 2 and the entered air is then blown out by the fan 3. The air outlet 12 is used for blowing out the air after heat exchange with the built-in heat exchanger 2. The blowing direction of the fan 3 is directed towards the air outlet 12. The air after heat exchange with the built-in heat exchanger 2 is blown out from the radiant heat dissipation casing 1 under the action of the fan 3, and then directed towards the room.

The air outlet 12 may be configured with a swinging blade, a cover plate, a motor and the like, which may employ the mounting structure of the existing air outlet of the indoor unit in order to realize swinging left and right, up and down to adjust the air direction. The cover plate covers the air outlet 12 after the indoor unit 100 is turned off.

The fan 3 and the built-in heat exchanger 2 are mounted in the radiant heat dissipation casing 1 through a bracket 5, respectively. The fan 3 is optionally mounted between the built-in heat exchanger 2 and the air outlet 12.

The fan 3 is connected with the control unit 400 through a wire for signaling, whereby the control unit 400 controls the switching of the fan 3.

As needed, the fan 3 may be mounted at an angle, such that it is located diagonally above or below the built-in heat exchanger 2 to avoid blocking the built-in heat exchanger 2.

As needed, the fan 3 may employ a roller air wheel, which is arranged and extends along the length direction of the built-in heat exchanger 2 to obtain sufficient air power, so as to blow both cold and hot air from the surface of the built-in heat exchanger 2 towards the air outlet 12.

As needed, an air duct may be connected between the built-in heat exchanger 2 and the air outlet 12, and the fan 3 is mounted in the air duct to reduce the loss of air flow.

As needed, an air duct may also be connected between the built-in heat exchanger 2 and the air inlet 11, which facilitates directing the air into the space where the built-in heat exchanger 2 is located to fully exchange heat.

In this application, the radiant heat dissipation casing 1 has the medium flow channel 13, and the medium flow channel 13 is connected with the medium circulation pipe 300 for circulation of the heat exchange medium for heat exchange with the indoor air or the ambient air, so as to enable the radiant heat dissipation casing 1 to have the function of a radiant heat exchanger or a radiant heat sink. The number or shape of the medium flow channels 13 can be set as needed.

In this application, the radiant heat dissipation casing 1 and the built-in heat exchanger 2 are connected with the medium circulation pipe 300 respectively, and the radiant heat dissipation casing 1 is arranged in parallel with the built-in heat exchanger 2. The indoor unit 100 and the outdoor unit 200 are connected with the control unit 400 through a wire for signaling, whereby the control unit 400 controls the switching of the indoor unit 100 and the outdoor unit 200.

The built-in heat exchanger 2 is connected with the medium circulation pipe 300, so that when the outdoor unit 200 is switched on, the heat exchange medium may enter into the heat exchanger flow path of the built-in heat exchanger 2 in order to exchange heat with the air that enters into the radiant heat dissipation casing 1 or the air that enters into the space in which the built-in heat exchanger 2 is located, and after heat exchange, the air is blown out of the air outlet 12 by the fan 3.

In this application, the air that enters the radiant heat dissipation casing 1 or the air that enters the space where the built-in heat exchanger 2 is located is referred to as fresh air or return air.

The medium flow channel 13 is connected with the medium circulation pipe 300, so that when the outdoor unit 200 is switched on, the heat exchange medium may enter into the medium flow channel 13 of the radiant heat dissipation casing 1 in order to exchange heat with the indoor air or ambient air, and utilize its own radiation ability to cool down or warm up the ambient air around it, so that there will not be a cold air or a hot air blowing to the user, and there will be no noise from the switching on of the fan, blower, and other devices.

As needed, corresponding control valves can be configured in the medium circulation pipe 300, the built-in heat exchanger 2, and the radiant heat dissipation casing 1 to control the circulation of the heat exchange medium, thereby controlling the operation state of the radiant heat dissipation casing 4 and the built-in heat exchanger 2.

When the built-in heat exchanger 2 and the radiant heat dissipation casing 1 supply cooling to the room, the built-in heat exchanger 2 and the radiant heat dissipation casing 1 are used as an evaporator.

When the built-in heat exchanger 2 and the radiant heat dissipation casing 1 supply heat to the room, the built-in heat exchanger 2 and the radiant heat dissipation casing 1 are used as a condenser.

The above switching method can be realized by configuring a four-way reversing valve in the outdoor unit 200, and the four-way reversing valve is in the prior art and will not be repeated herein.

Hereby, an air conditioning system provided by the application can realize the mode of simultaneously turning on the radiant heat dissipation casing 1 and the built-in heat exchanger 2, the mode of solely turning on the built-in heat exchanger 2 and the mode of solely turning on the radiant heat dissipation casing 1.

For case of description, in this application, the mode of turning on the radiant heat dissipation casing 1 and the built-in heat exchanger 2 is called a first operation mode of the indoor unit 100, the mode of solely turning on the built-in heat exchanger 2 is called a second operation mode of the indoor unit 100, and the mode of solely turning on the radiant heat dissipation casing 1 is called a third operation mode of the indoor unit 100, so that the user can choose from a number of modes, which meets the needs of different operation conditions.

When users need to quickly adjust the indoor temperature, they can optionally switch on the radiant heat dissipation casing 1 and the built-in heat exchanger 2 at the same time, and the radiant heat dissipation casing 1 and the built-in heat exchanger 2 will exchange heat or dissipate heat together to quickly adjust the indoor temperature. If the indoor temperature is within a certain range, and the user feels that current demand for heat exchange can be satisfied solely by the built-in heat exchanger 2, users can choose to separately use the built-in heat exchanger 2 to adjust the indoor temperature to meet the needs of different users and operation conditions. After the indoor temperature reaches the preset temperature, users can choose to switch off the built-in heat exchanger 2 and keep the radiant heat dissipation casing 1 on, dissipating heat only through the radiant heat dissipation casing 1, in order to slowly dissipate the heat to the room, to keep the indoor temperature within a certain range, there will be no cold or hot air continuously blowing to the user, and there will be no noise, which enhances the user's experience.

Take cooling and decreasing the temperature as an example:

If the indoor temperature exceeds 30° C. (the temperature threshold, which can be chosen by the users themselves), then the first operation mode can be selectively employed, although the radiation heat dissipation casing 1 exchanges heat relatively slowly compared with the built-in heat exchanger 2, it plays a role in assisting the heat exchange and cooling, and also enhancing the efficiency or effect of indoor cooling.

If the indoor temperature is between 26° C. to 28° C. (the temperature threshold, which can be chosen by the users themselves), some users may feel hot, and some users may feel only slightly hot, so the user can choose to solely turn on the built-in heat exchanger 2 to slightly faster the cooling, or solely turn on the radiant heat dissipation casing 1 for slowly cooling, it can meet the different needs for different users, the workload of the outdoor unit 200 will not be in a fully loaded state and there is also a power saving effect.

If the indoor temperature is already between 22° C. to 26° C. (the temperature threshold, which can be chosen by the users themselves), most of the users feel that the body temperature under this temperature is more appropriate. In order to avoid the cold air blowing to the user, especially blowing to the infants and young children, the third operation mode may be chosen, dissipating heat only through the radiant heat dissipation casing 1, in order to slowly dissipate the heat to the room, to keep the indoor temperature within a certain range. There will be no cold air continuously blowing to the user, and there will be no noise, which enhances the user's experience.

Take heating and increasing the temperature as an example:

If the indoor temperature is below 16° C. (the temperature threshold, which can be chosen by the users themselves), then the first operation mode can be selectively employed, although the radiation heat dissipation casing 1 exchanges heat relatively slowly compared with the built-in heat exchanger 2, it plays a role in assisting the heat exchange and heating, and also enhancing the efficiency or effect of indoor heating.

If the indoor temperature is between 19° C. to 22° C. (the temperature threshold, which can be chosen by the users themselves), some users may feel slightly cold, and some users may feel it is warm enough, so the user can choose to solely turn on the built-in heat exchanger 2 to slightly faster the heating, or solely turn on the radiant heat dissipation casing 1 for slowly heating, it can meet the different needs for different users, the workload of the outdoor unit 200 will not be in a fully loaded state and there is also a power saving effect.

If the indoor temperature is already between 22° C. to 25° C. (the temperature threshold, which can be chosen by the users themselves), most of the users feel that the body temperature under this temperature is more appropriate. In order to avoid the warm air blowing to the user directly, especially blowing to the infants and young children, the third operation mode may be chosen, dissipating heat only through the radiant heat dissipation casing 1, in order to slowly dissipate the heat to the room, to keep the indoor temperature within a certain range. There will be no warm air continuously blowing to the user, and there will be no noise, which enhances the user's experience.

In this application, the housing of the indoor unit 100 includes a pedestal, and the radiant heat dissipation casing 1 is mounted on the pedestal.

If the indoor unit 100 is a wall-mounted air conditioner indoor unit, the pedestal is a back plate against the wall side. The radiant heat dissipation casing 1 is mounted on the base as a cover plate.

If the indoor unit 100 is a standing type air conditioner indoor unit (cabinet unit), the pedestal is a bottom base in contact with the ground, and the radiant heat dissipation casing 1 is in a box-type structure, which is mounted on the bottom base, and has a top surface and four sides capable of exchanging heat and dissipating heat. Certainly, according to the actual situation, the side against the wall and the top surface can directly use a metal plate or a plastic plate, the radiant heat dissipation casing 1 from the top view is roughly an U-shaped structure, with three sides capable of the heat exchange.

As needed, a protective coating (such as a paint coating) may be provided on the outer surface of the radiant heat dissipation casing 1 to provide rust prevention.

As needed, a decorative coating (such as a pictorial decorative layer) may be provided on the outer surface of the radiant heat dissipation casing 1 to play an aesthetic role.

As needed, heat dissipation fins may be provided on the outer surface of the radiant heat dissipation casing 1 to improve the heat exchange effect.

Figure 2:
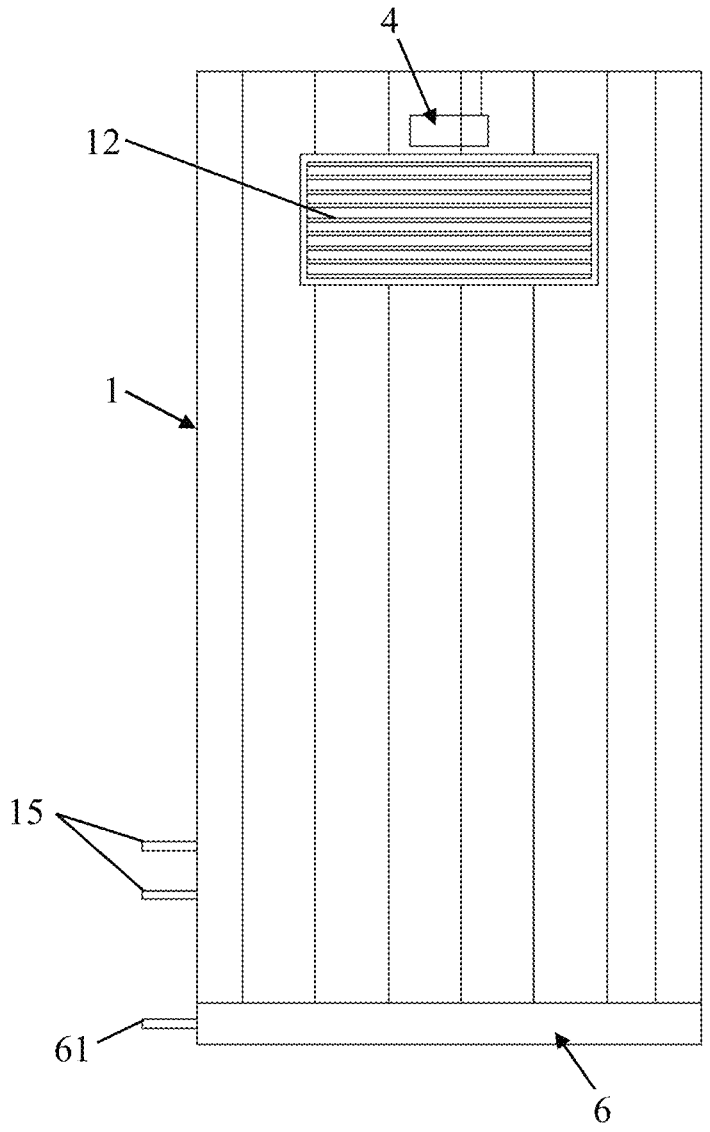
FIG. 2 is the front view of an indoor unit.
Figure 3:
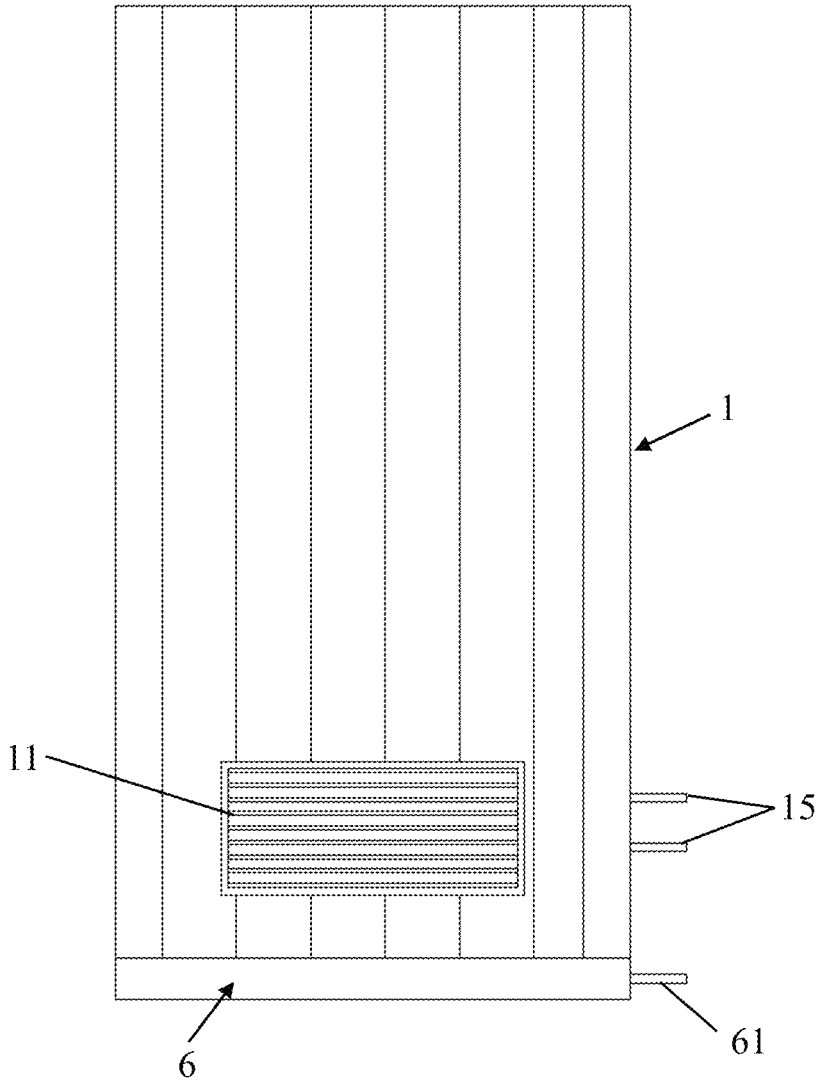
FIG. 3 is the rear view of the indoor unit.

As needed, as shown in FIGS. 2 to 3, a water catch basin 6 may be configured at the bottom of the indoor unit 100 for collecting condensed water. One end of the water catch basin 6 has a water pipe connector 61 for connecting with a water pipe to drain the water in the water catch basin 6 to a specified area.

As needed, as shown in FIGS. 2 to 3, an adapter 15 may be configured on the housing or the radiant heat dissipation casing 1 of the indoor unit 100 for connecting with the medium circulation pipe 300 to direct the medium circulation pipe 300 into the inner side of the radiant heat dissipation casing 1 for connecting with the built-in heat exchanger 2, and also to facilitate the connection of the medium circulation pipe 300 to the radiant heat dissipation casing 1.

Specifically, the adapters 15 comprise two first adapters, and a section of the medium circulation pipe 300 connected with the built-in heat exchanger 2 (specifically, the first branch pipe 302 described below) is connected with or passes through the first adapters.

The adapter 15 comprises two second adapters, a section of the medium circulation pipe 300 connected with the radiant heat dissipation casing 1 (specifically the second branch pipe 303 described below) is connected with or passes through the second adapters. Preferably, one of the second adapters is connected with the inlet of the medium flow channel 13 and the other is connected with the outlet of the medium flow channel 13, and the section of the medium circulation pipe 300 that is connected with the radiant heat dissipation casing 1 is directly connected with both second adapters.

Figure 4:
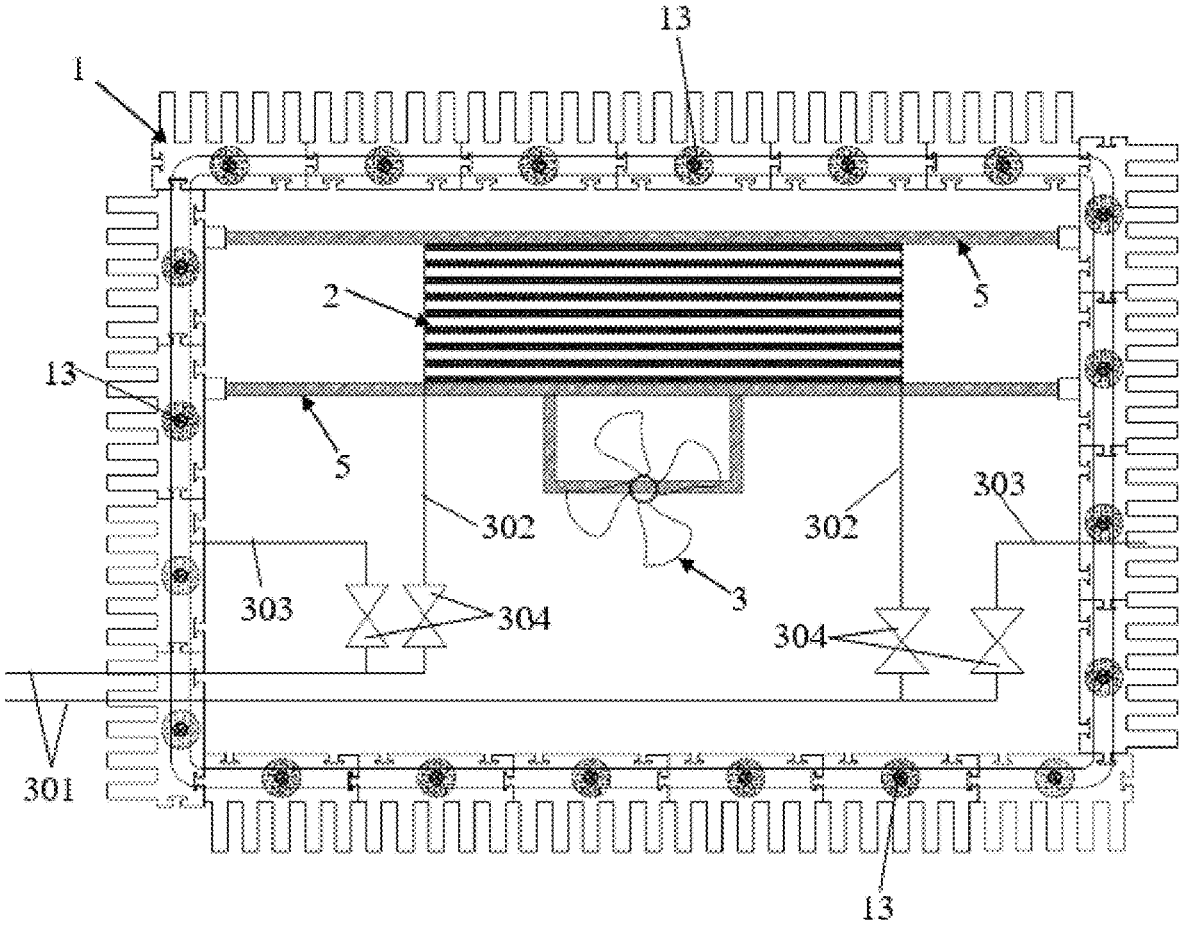
FIG. 4 is an internal structure schematic diagram of the indoor unit, wherein the radiation heat dissipation casing in in the shape of a square structure.
Figure 8:
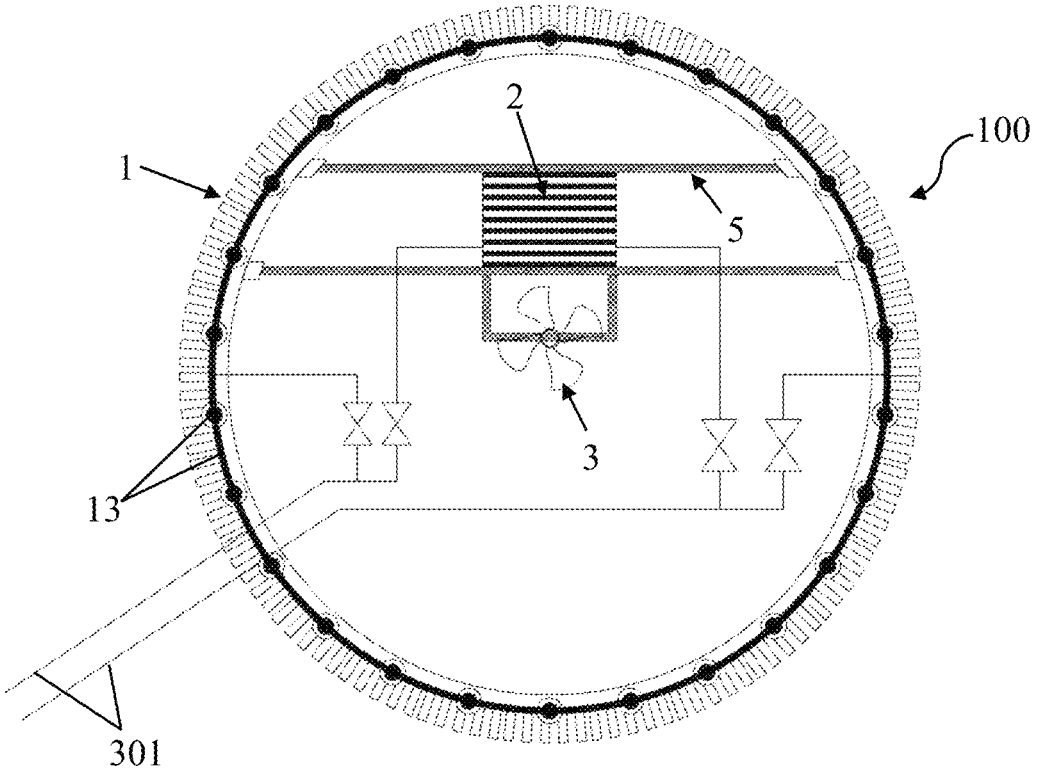
FIG. 8 is an internal structure schematic diagram of the indoor unit, wherein the radiation heat dissipation casing in in the shape of a circular structure.

In one of the embodiments, as shown in FIGS. 4 and 8, a plurality of medium flow channels 13 are comprised in the radiant heat dissipation casing 1 to enhance the heat dissipation and heat exchange capacity of the radiant heat dissipation casing 1.

Figure 11:
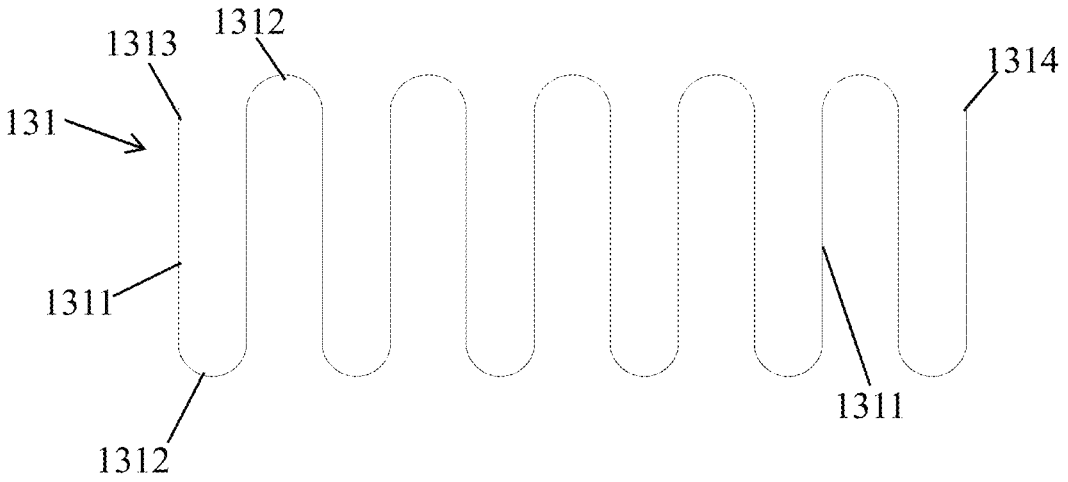
FIG. 11 is a schematic diagram of a first branch flow channel.

In one of the embodiments, as shown in FIG. 11, the medium flow channel 13 includes a first branch flow channel 131, the first branch flow channel 131 comprises a plurality of vertically arranged and sequentially connected vertical branch flow channels 1311, any two adjacent vertical branch flow channels 1311 are connected by a U-shaped bend pipe 1312, and the medium circulation pipeline 300 is connected with the first branch flow channel 131 to extend the heat exchange path of the radiant heat dissipating casing 1 in the circumferential and height directions, enhancing the heat exchange and heat dissipation capabilities.

Specifically, the medium circulation pipe 300 is connected with the first inlet 1313 and the first outlet 1314 of the first branch flow channel 131.

Figure 12:
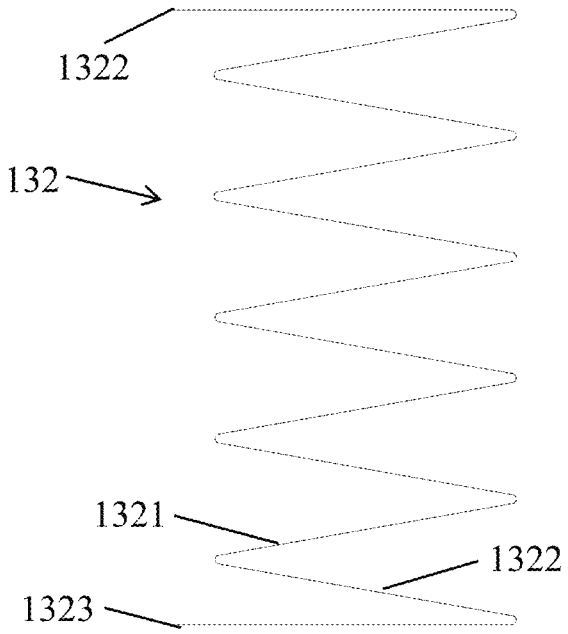
FIG. 12 is a schematic diagram of a second branch flow channel.

In one of the embodiments, as shown in FIG. 12, the medium flow channel 13 comprises a second branch flow channel 132, the second branch flow channel 132 comprises a plurality of spiral climbing transverse branch flow channels 1321 connected in sequence, and the medium circulation pipe 300 is connected with the second branch flow channel 132 to extend the heat exchange path of the radiant heat dissipating casing 1 in the circumferential and height directions, enhancing the heat exchange and heat dissipation capabilities.

Specifically, the medium circulation pipe 300 is connected with a second inlet 1322 and a second outlet 1323 of the second branch flow channel 132.

The first branch flow channel 131 and the second branch flow channel 132 are independent of each other, which can avoid cross talk of the medium between the first branch flow channel 131 and the second branch flow channel 132.

As needed, electromagnetic control valves can be provided in the first branch flow channel 131 and the second branch flow channel 132 respectively, which are connected with the control unit 400, and the control unit 400 controls the switching of the respective control valves 304, thereby the first branch flow channel 131 and the second branch flow channel 132 are controlled to circulate the medium respectively or simultaneously to control the radiation heat exchange and heat dissipation capabilities of the radiation heat dissipation casing 1.

In one of the embodiments, as shown in FIG. 1, FIG. 4, FIG. 8, and FIG. 10, the medium circulation pipe 300 comprises a main pipe 301 connected with the outdoor unit 200, a first branch pipe 302 connected between the main pipe 301 and the built-in heat exchanger 2, and a second branch pipe 303 connected between the main pipe 301 and the radiant heat dissipation casing 1.

The first branch pipe 302 and the second branch pipe 303 are each provided with a control valve 304, the control valve 304 is in signal communication with the control unit 400.

In this embodiment, the medium circulation pipe 300 is divided into the main pipe 301, the first branch pipe 302, and the second branch pipe 303. The main pipe 301, the first branch pipe 302, and the second branch pipe 303 respectively comprise a supply pipe and a return pipe.

The first branch pipe 302 and the second branch pipe 303 are connected with the main pipe 301 respectively, and the main pipe 301 is connected with the outdoor unit 200. The first branch pipe 302 is connected with the built-in heat exchanger 2, and the second branch pipe 303 is connected with the radiant heat dissipation casing 1.

The first branch pipe 302 and the second branch pipe 303 are respectively provided with control valves 304, the control valves 304 may be an electromagnetic control valve, the control valves 304 are connected with the control unit 400 through wires to realize signal transmission, and the switching of each control valve 304 is controlled by the control unit 400.

When the control valve 304 in the second branch pipe 303 and the control valve 304 in the first branch pipe 302 are switched on, both the built-in heat exchanger 2 and the radiant heat dissipation casing 1 are operating, and the indoor unit 100 is in the first operation mode.

When the control valve 304 of the second branch pipe 303 is switched off and the control valve 304 in the first branch pipe 302 is switch on, the built-in heat exchanger 2 operates, the radiant heat dissipation casing 1 does not operate, and the indoor unit 100 is in the second operation mode.

When the control valve 304 in the second branch pipe 303 is switched on and the control valve 304 in the first branch pipe 302 is switched off, the built-in heat exchanger 2 does not operate, the radiant cooling housing 1 operates, and the indoor unit 100 is in the third operation mode.

The second branch pipe 303 may comprises two pipe outlets and two pipe return ports, the two pipe outlets are connected with the inlets of the first branch flow channel 131, the second branch flow channel 132, respectively, and the two pipe return ports are connected with the outlets of the first branch flow channel 131, the second branch flow channel 132, respectively.

Figure 10:
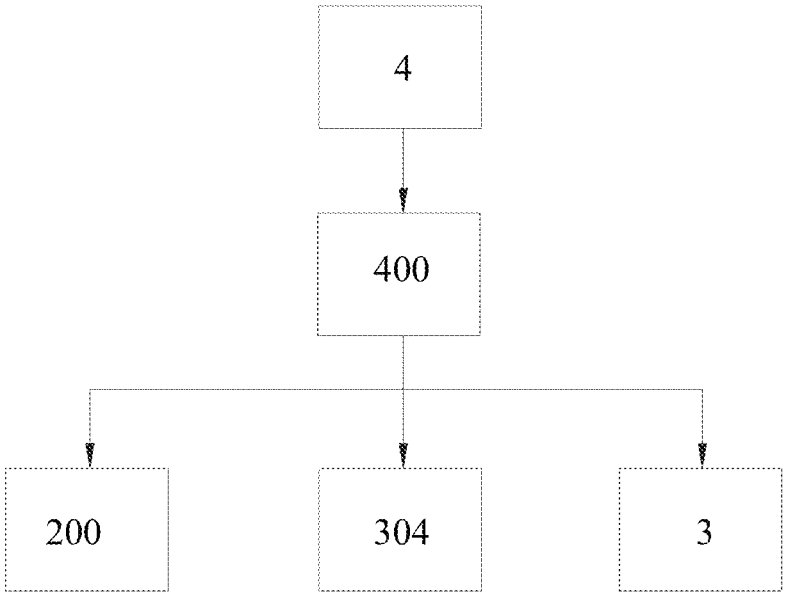
FIG. 10 is a schematic diagram showing a temperature sensor, outdoor unit, fan and control valve in signal communication with a control unit.

In one of the embodiments, as shown in FIG. 2, and FIG. 10, the air conditioning system also comprises a temperature sensor 4 for monitoring indoor temperature, the temperature sensor 4 is in signal communication with the control unit 400.

In this embodiment, the temperature sensor 4 may be configured on an indoor wall or on the housing of the indoor unit 100 for monitoring the indoor temperature. Preferably, the temperature sensor 4 is mounted on the indoor wall and avoids the air outlet 12 of the indoor unit 100.

The temperature sensor 4 is in signal communication with the control unit 400, either through wire or wireless connection. The temperature sensor 4 transmits the monitored real-time temperature to the control unit 400, and the control unit 400 controls the switching of the outdoor unit 200 and the indoor unit 100, which is convenient to use and helps to save electricity consumption.

The air conditioning system has a manual mode and an automatic mode, and the users can choose the automatic mode when they use it at home.

In summer, for example, if the temperature sensor 4 monitors that the indoor temperature is higher than 28° C. (the temperature threshold, which can be chosen by the users themselves), the air conditioning system is automatically turned on. If the temperature sensor 4 monitors that the indoor temperature is lower than 22° C. (the temperature threshold, which can be chosen by the users themselves), the air conditioning system is automatically turned off.

In winter, for example, if the temperature sensor 4 monitors that the indoor temperature is lower than 18° C. (the temperature threshold, which can be chosen by the users themselves), the air conditioning system is automatically turned on. If the temperature sensor 4 monitors that the indoor temperature is higher than 25° C. (the temperature threshold, which can be chosen by the users themselves), the air conditioning system is automatically turned off.

In one of the embodiments, a temperature threshold is preset in the control unit 400, the temperature threshold comprises a cooling temperature threshold and a heating temperature threshold.

The cooling temperature threshold comprises T1 and T2, wherein $T1<T2$.

When the temperature sensor 4 monitors an indoor temperature $T0\geq T2$, the indoor unit 100 is in the first operation mode.

When the temperature sensor 4 monitors an indoor temperature $T1\leq T0<T2$, the indoor unit 100 is in the second operation mode.

When the temperature sensor 4 monitors an indoor temperature $T0<T1$, the indoor unit 100 is in the third operation mode.

The heating temperature threshold comprises T3 and T4, wherein $T3<T4$.

When the temperature sensor 4 monitors an indoor temperature $T0\leq T3$, the indoor unit 100 is in the first operation mode.

When the temperature sensor 4 monitors an indoor temperature $T3\leq T0<T4$, the indoor unit 100 is in the second operation mode.

When the temperature sensor 4 monitors an indoor temperature $T0\geq T4$, the indoor unit 100 is in the third operation mode.

In this embodiment, by presetting the temperature threshold, the indoor unit 100 can be realized to automatically switch between the first operation mode, the second operation mode and the third operation mode.

The specific values of T1, T2, T3, and T4 described above may be set by the users according to their needs.

For example, T1 takes a value between 26° C. and 30° C., T2 takes a value between 24° C. and 26° C. T3 takes a value between 16° C. and 22° C., and T4 takes a value between 22° C. and 26° C.

In one of the embodiments, the radiant heat dissipation casing 1 may be formed integrally using a blown-up plate.

In one of the embodiments, as shown in FIGS. 4 to 9, the radiant heat dissipation casing 1 comprises a plurality of housing modules 10 connected in sequence, an outer surface of the housing modules 10 has heat dissipation fins 103. Each of the housing modules 10 has at least one of the medium flow channels 13.

In this embodiment, the radiant heat dissipation casing 1 comprises a plurality of housing modules 10 connected in sequence. The housing module 10 is a metal heat sink, preferably an aluminum alloy heat sink. Each housing module 10 is integrally provided with a plurality of heat dissipation fins 103 on its outer surface, which has a large contact area with the ambient space, and a good heat exchange and heat dissipation effect.

Each housing module 10 has at least one medium flow channel 13, and after two adjacent housing modules 10 are assembled, the medium flow channels 13 in the two adjacent housing modules 10 are connected in a sealed manner. Specifically, a female plug may be provided at one end of the medium flow channel 13 of each housing module 10, and a male plug may be provided at the other end, and when docking the two adjacent housing modules 10, the male plug is inserted into the female plug to complete the sealed connection.

It should be noted that if the entire medium flow channel in the radiant heat dissipation casing 1 is regarded as the whole medium flow channel, the medium flow channel in the housing module 10 is a portion of or a section of the whole medium flow channel.

Two adjacent housing modules 10 may be connected by pins, buckles, and the like.

In one of the embodiments, as shown in FIGS. 4 to 6 and FIGS. 8 to 9, one end of the housing module 10 has a buckle 101 and the other end of the housing module has a slot 102. In any of the two adjacent housing modules 10, the buckle 101 of one housing module 10 is in snap-fit connection with the slot 102 of another housing module 10.

In this application, two adjacent housing modules 10 are connected by buckles to facilitate assembly.

Along the left-right direction or in the circumferential direction, each of the housing modules 10 is provided with a buckle 101 at one end and a slot 102 at its other end. The buckles 101 on one housing module 10 is capable of being snapped into the slot 102 on another housing module 10. When assembled, the buckle 101 of any two adjacent housing modules 10 snap with the corresponding slot 102 to complete the assembly.

As needed, one end of the housing module 10 can be provided with two buckles 101 arranged vertically at intervals, and the other end is correspondingly provided with two slots 102 arranged at intervals vertically to improve connection stability.

Figure 9:
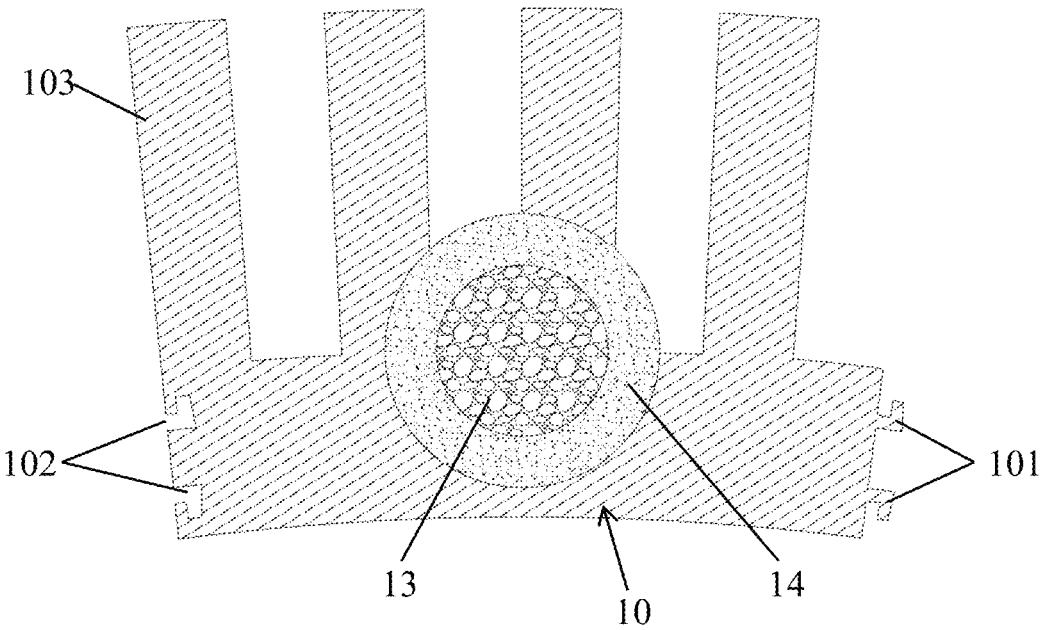
FIG. 9 is a sectional diagram of an arc-shaped housing module along the horizontal direction.

In one of the embodiments, as shown in FIGS. 8 to 9, the housing module 10 is in the shape of arc and a plurality of the housing modules 10 are sequentially connected to form a circular structure.

In this embodiment, each housing module 10 is in arc-shaped, and the plurality of housing modules 10 form a circular casing after being connected sequentially, which is suitable for a circular standing type air conditioner indoor unit.

Figure 5:
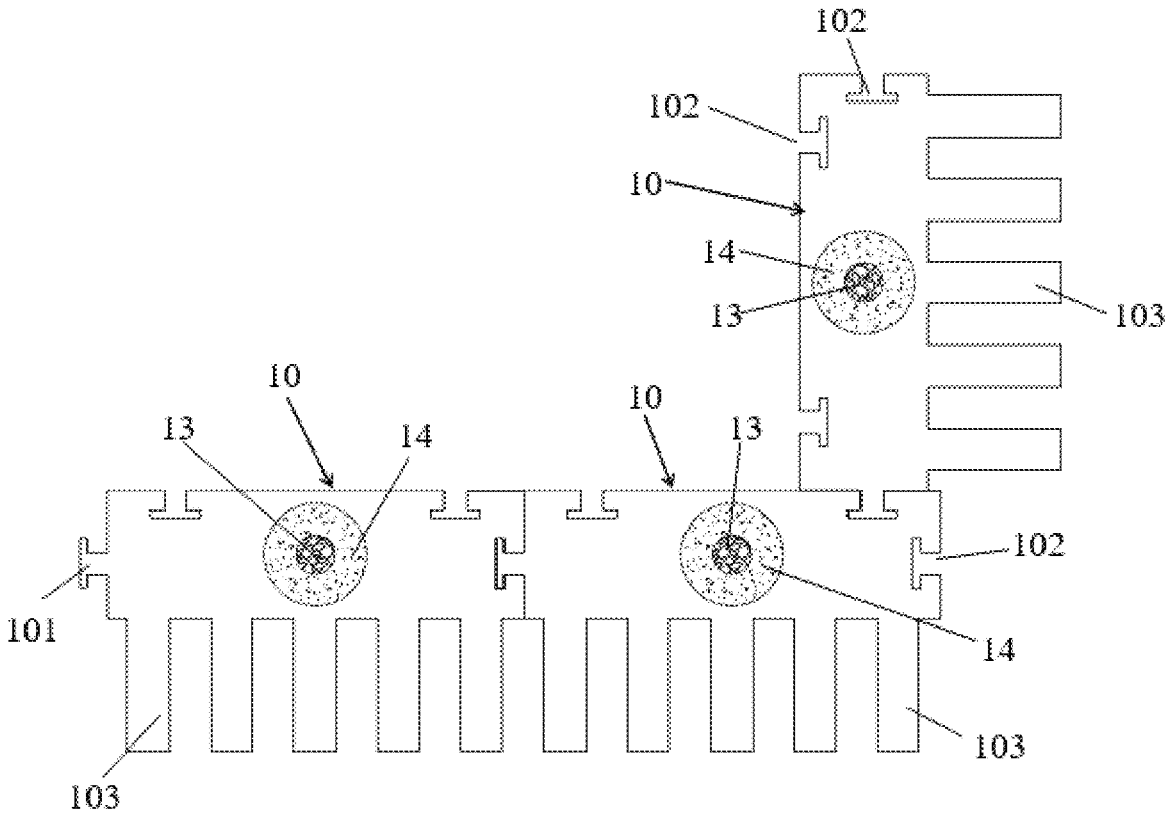
FIG. 5 is a schematic diagram of three rectangular housing modules spliced together.
Figure 6:
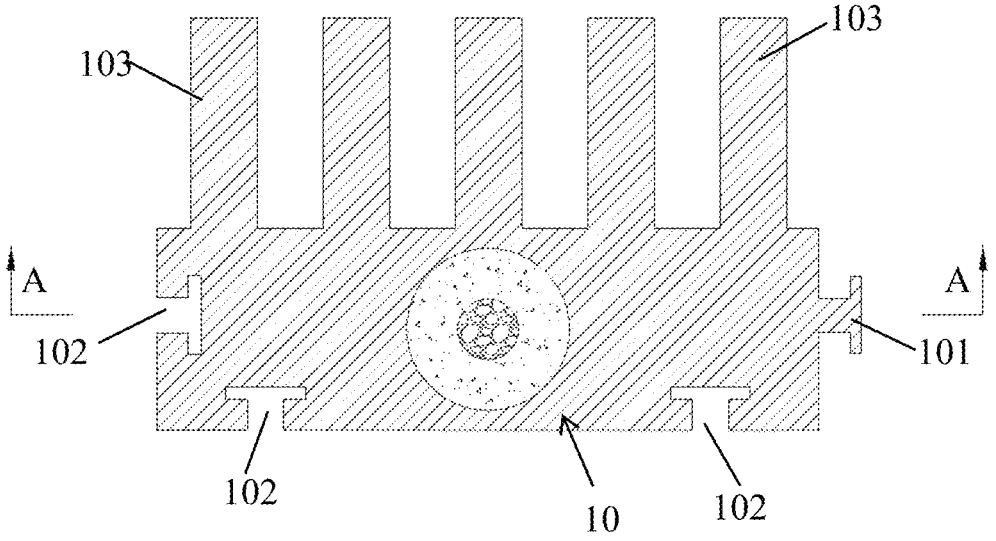
FIG. 6 is a sectional diagram of a rectangular housing module along the horizontal direction.

In one of the embodiments, as shown in FIGS. 4 to 6, the housing modules 10 is in the shape of rectangle, and a plurality of the housing modules 10 are sequentially connected to form a square structure, wherein the slots 102 are also provided at both end of an inner surface of the housing module 10, in two vertically arranged housing modules 10, the buckle 101 of one of the housing modules 10 is snap-fitted into the slot 101 of the other of the housing modules 10.

In this embodiment, each housing module 10 is in rectangular shape and a plurality of the housing modules 10 are sequentially connected to form a square structure, which is suitable for square or box-shaped standing air-conditioning indoor units.

In order to obtain a right-angled corner, the two ends of the inner surface of the housing module 10 are also provided with slots 102 respectively. Among the two housing modules 10 at the corner, the buckle 101 at one end of one housing module 10 is locked into the buckle 102 on the inner surface of the other housing module 10 to realize turning.

Figure 7:
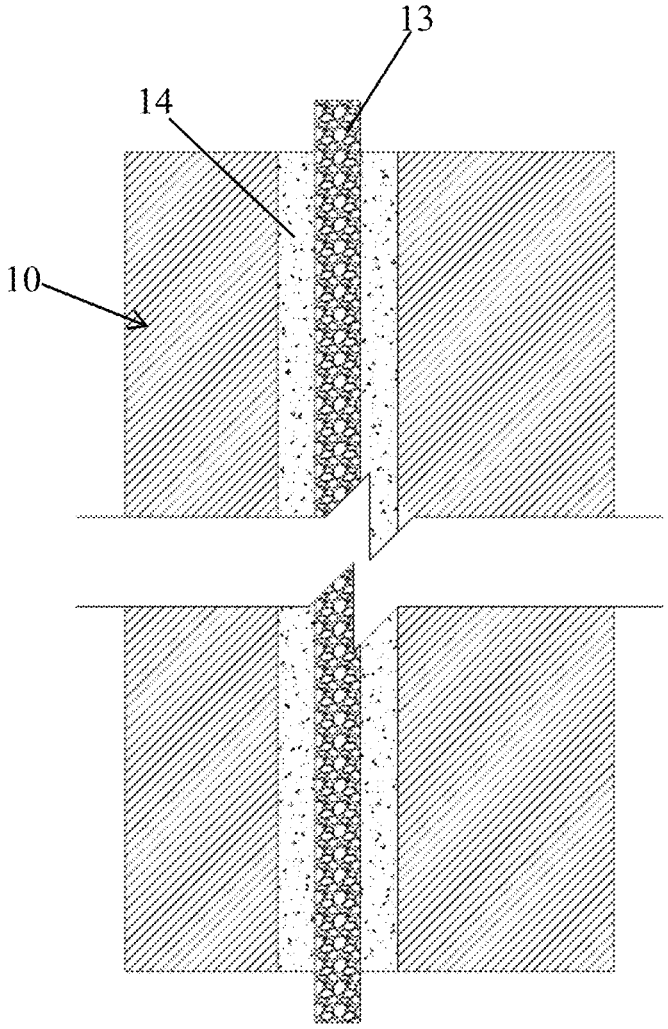
FIG. 7 is a sectional view along the A-A direction in FIG. 6.

In one of the embodiments, as shown in FIG. 7, an outer side of the medium flow channel 13 is covered with a thermally conductive sound deadening medium 14, which serve to conduct heat and muffle sound. Specifically, the medium flow channel 13 is a pipe provided in the radiant heat dissipation casing 1, and accordingly, a corresponding channel or hole will be provided in the radiant heat dissipation casing 1. The pipe passes through the channel or hole, and the thermally conductive sound deadening medium 14 is filled between the pipe and the wall of the channel or hole. Both ends of the channel or hole are sealed by end caps to prevent the thermally conductive sound deadening medium 14 from leaking.

The thermally conductive sound deadening medium 14 may be graphite powder, which has a good heat-conducting effect and a stable performance. During the thermal expansion and contraction of the medium flow channel 13 of the pipe structure, it generates a certain noise (for example, a clattering sound), the graphite powder may also absorb a part of the acoustic wave energy and reduces the noise.

An embodiment of the application provides a control method of the air conditioning system as described in the previous embodiments, wherein the control method comprises the following steps:

The step of simultaneously switching on the built-in heat exchanger 2 and the radiant heat dissipation casing 1, such that both the radiant heat dissipation casing 1 and the built-in heat exchanger 2 is in a heat exchange operation state.

The step of individually switching on the built-in heat exchanger 2, such that the built-in heat exchanger 2 is in a heat exchange operation state and the radiant heat dissipation casing 1 is in an inoperation state.

The step of individually switching on the radiant heat dissipation casing 1, such that the radiant heat dissipation casing 1 is in a heat exchange operation state and the built-in heat exchanger 2 is in an inoperation state.

The application provides a control method of an air conditioning system, when users need to quickly adjust the indoor temperature, they can optionally switch on the radiant heat dissipation casing 1 and the built-in heat exchanger 2 at the same time, and the radiant heat dissipation casing 1 and the built-in heat exchanger 2 will exchange heat or dissipate heat together to quickly adjust the indoor temperature. If the indoor temperature is within a certain range, and the user feels that the current demand for heat exchange can be satisfied solely through the built-in heat exchanger 2, users can choose to separately use the built-in heat exchanger 2 to adjust the indoor temperature to meet the needs of different users and operation conditions. After the indoor temperature reaches the preset temperature, users can choose to switch off the built-in heat exchanger 2 and keep the radiant heat dissipation casing 1 on, dissipating heat only through the radiant heat dissipation casing 1, in order to slowly dissipate the heat to the room, to keep the indoor temperature within a certain range, there will be no cold or hot air continuously blowing to the user, and there will be no noise, which enhances the user's experience.

In summary, the application provides an air conditioning system and a control method thereof, which utilizes the housing of an indoor cabinet unit as a radiant heat sink, which reduces the space occupied by the radiant heat sink, and facilitates the installation of the radiant heat sink. The radiant heat sink (radiant heat dissipation casing) and convection heat sink (built-in heat exchanger) are combined into one. The radiant heat sink and convection heat sink can operate separately or simultaneously, which increase the operation mode of air conditioner and enhance the comfort of the air conditioner.

The above technical solutions may be combined as required to achieve the best technical effect.

The above are merely the principle and the preferred embodiments of the application. It should be pointed out that, for those of ordinary skills in the art, several other modifications may be made on the basis of the principle of the application, which should also be regarded as falling in the protection scope of the application.

The invention claimed is:

1. An air conditioning system comprising an indoor unit, an outdoor unit, a medium circulation pipe and a control unit;

the indoor unit and the outdoor unit being connected through the medium circulation pipe, and the outdoor unit being in signal communication with the control unit;

wherein the indoor unit comprises a radiant heat dissipation casing having a medium flow channel and a built-in heat exchanger and a fan mounted in the radiant heat dissipation casing, the fan is in signal communication with the control unit;

the radiant heat dissipation casing comprises an air inlet and an air outlet;

the radiant heat dissipation casing and the built-in heat exchanger are connected with the medium circulation pipe respectively, and the radiant heat dissipation casing is arranged in parallel with the built-in heat exchanger;

the indoor unit has a first operation mode, wherein both the radiant heat dissipation casing and the built-in heat exchanger are in a heat exchange operation state;

the indoor unit has a second operation mode, wherein the built-in heat exchanger is in a heat exchange operation state and the radiant heat dissipation casing is in an inoperation state;

the indoor unit has a third operation mode, wherein the radiant heat dissipation casing is in a heat exchange operation state and the built-in heat exchanger is in an inoperation state, wherein the radiant heat dissipation casing comprises a plurality of the medium flow channels therein, wherein the radiant heat dissipation casing comprises a plurality of housing modules connected in sequence, an outer surface of the housing module has heat dissipation fins, each of the housing modules has at least one of the medium flow channels, wherein a female plug is provided at one end of the medium flow channel of each housing module, and a male plug is provided at the other end, and when docking the two adjacent housing modules, the male plug is inserted into the female plug to complete the sealed connection.

2. The air conditioning system according to claim 1, wherein the medium circulation pipe comprises a main pipe connected with the outdoor unit, a first branch pipe connected between the main pipe and the built-in heat exchanger, and a second branch pipe connected between the main pipe and the radiant heat dissipation casing;

the first branch pipe and the second branch pipe are each provided with a control valve, the control valve is in signal communication with the control unit.

3. The air conditioning system according to claim 1, wherein the air conditioning system also comprises a temperature sensor for monitoring indoor temperature, the temperature sensor is in signal communication with the control unit.

4. The air conditioning system according to claim 3, wherein a temperature threshold is preset in the control unit, the temperature threshold comprises a cooling temperature threshold and a heating temperature threshold;

the cooling temperature threshold comprises T1 and T2, wherein $T1<T2$;

when the temperature sensor monitors an indoor temperature $T0\geq T2$, the indoor unit is in the first operation mode;

when the temperature sensor monitors an indoor temperature $T1\leq T0<T2$, the indoor unit is in the second operation mode;

when the temperature sensor monitors an indoor temperature $T0<T1$, the indoor unit is in the third operation mode;

the heating temperature threshold comprises T3 and T4, wherein $T3<T4$;

when the temperature sensor monitors an indoor temperature $T0\leq T3$, the indoor unit is in the first operation mode;

when the temperature sensor monitors an indoor temperature $T3\leq T0<T4$, the indoor unit is in the second operation mode;

when the temperature sensor monitors an indoor temperature $T0\geq T4$, the indoor unit is in the third operation mode.

5. The air conditioning system according to claim 1, wherein one end of the housing modules has a buckle and the other end of the housing modules has a slot;

in any of the two adjacent housing modules, the buckle of one of the housing modules is in snap-fit connection with the slot of another of the housing modules.

6. The air conditioning system according to claim 5, wherein the housing module is in the shape of arc and a plurality of the housing modules are sequentially connected to form a circular structure; or the housing modules is in the shape of rectangle, and a plurality of the housing modules are sequentially connected to form a square structure, wherein the slots are also provided at both end of an inner surface of the housing module, in two vertically arranged housing modules, the buckle of one of the housing modules is snap-fitted into the slot of another of the housing modules.

7. The air conditioning system according to claim 1, wherein an outer side of the medium flow channel is covered with a thermally conductive sound deadening medium.

8. A control method of the air conditioning system according to claim 1, wherein the control method comprises the following steps:

the step of simultaneously switching on the built-in heat exchanger and the radiant heat dissipation casing, such that both the radiant heat dissipation casing and the built-in heat exchanger is in a heat exchange operation state;

the step of individually switching on the built-in heat exchanger, such that the built-in heat exchanger is in a heat exchange operation state and the radiant heat dissipation casing is in an inoperation state;

the step of individually switching on the radiant heat dissipation casing, such that the radiant heat dissipation casing is in a heat exchange operation state and the built-in heat exchanger is in an inoperation state.

* * * * *